United States Patent [19]

Empson

Best Available Copy

[11] 4,245,563

[45] Jan. 20, 1981

[54] HYDRAULICALLY DAMPED RAILWAY CAR BODY ROLL

[76] Inventor: Kenneth G. Empson, 45 Briarcliff Rd., Boulder Hill, Oswego, Ill. 60543

[21] Appl. No.: 51,698

[22] Filed: Jun. 25, 1979 (Under 37 CFR 1.47)

[51] Int. Cl.[3] ..... B61F 5/06; B61F 5/12; B61F 5/24

[52] U.S. Cl. ..... 105/197 DH; 105/199 A; 267/3; 267/8 A; 267/9 A

[58] Field of Search ..... 105/197 DH, 197 D, 199 R, 105/199 A; 267/4, 8 A, 3, 9 A; 293/134; 26/126; 188/33

[56] References Cited

U.S. PATENT DOCUMENTS

| | | | |
|---|---|---|---|
| 1,821,787 | 9/1931 | Black | 26/126 |
| 3,035,714 | 5/1962 | Peterson | 213/43 |
| 3,275,164 | 9/1966 | Peterson | 213/43 |
| 3,464,366 | 9/1969 | Seay | 105/197 D X |
| 3,595,350 | 7/1971 | Wiebe | 105/197 D X |
| 3,626,864 | 12/1971 | Wiebe | 105/199 R |
| 3,773,147 | 11/1973 | Wiebe | 188/33 |
| 3,774,895 | 11/1973 | Willich et al. | 293/134 |
| 3,837,292 | 9/1974 | Wiebe | 105/197 DH |
| 3,841,681 | 10/1974 | Dera et al. | 293/134 |
| 3,874,307 | 4/1975 | Schuam | 105/197 DH |

OTHER PUBLICATIONS

Conway, H. G., Landing Gear Design; The Royal Aeronautical Society; Textbook; Chapman and Hall Ltd.; 1958; pp. 178–189 inc.

*Primary Examiner*—Howard Beltran

[57] ABSTRACT

An arrangement for controlling car body roll in high capacity railroad freight cars, in accordance with which a hydro-pneumatic roll contact unit is incorporated in the car truck spring groups that support the respective truck bolsters. The roll control unit comprises a base housing defining a lower or outer cylinder having an upstanding piston rod structure equipped with a piston head that reciprocably mounts a tubular ram having a ram head that operates in the outer cylinder and defines an upper or inner cylinder in which the base housing piston head operates. An annular rolling seal is received in circumambient relation about and connected to both cylinders invaginating leak free relation thereto, which defines an annular reservoir about said cylinders with which both cylinders have communication. The cylinders and the reservoir are given a hydraulic liquid charge sufficient to fully fill the two cylinders and the lower portion of the reservoir, and a gas charge within the reservoir that forms a pressurized gas pocket above the level of the hydraulic liquid charge in the reservoir. The gas charge maintains the unit in constant contact with the bolster and side frame seats. In functioning to control body roll, both cylinders resist roll under constant pressure conditions while the outer or lower cylinder provides supplemental resistance under velocity sensitive conditions, with the hydraulic liquid cycling through the hydraulic system of the unit as the unit operates as part of a bolster spring group.

14 Claims, 9 Drawing Figures

FIG. 1
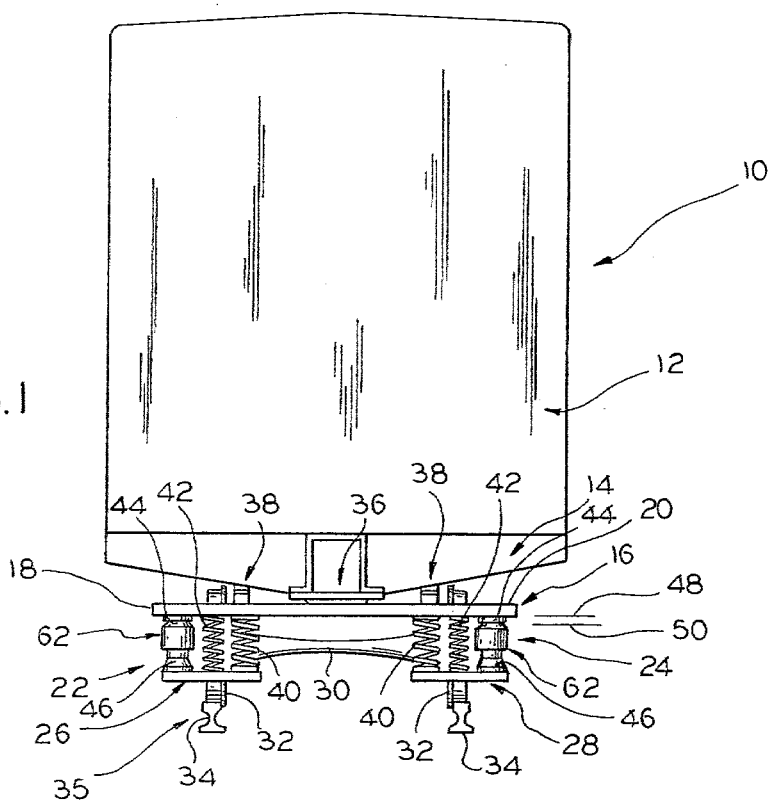
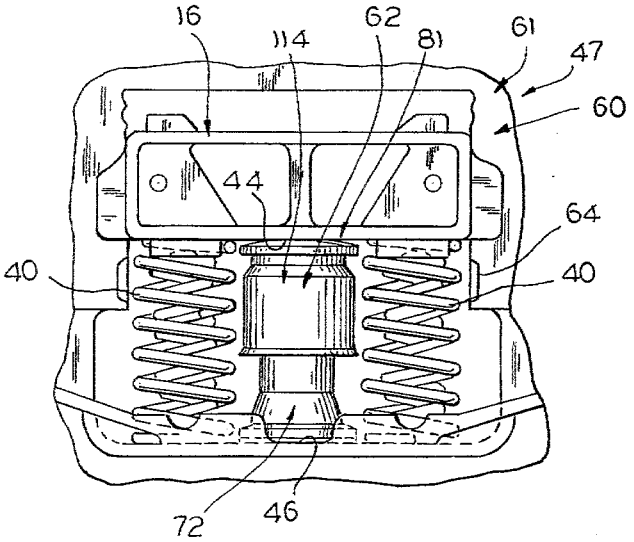
FIG. 2
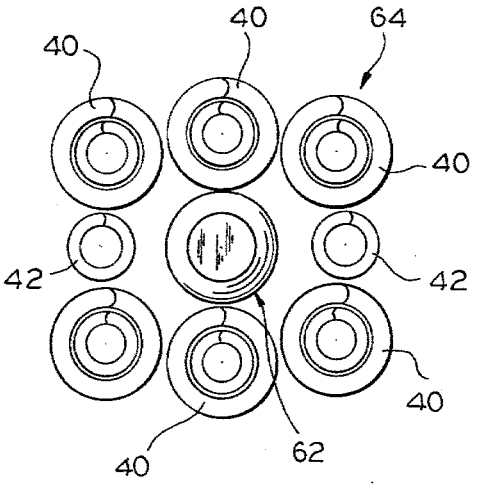
FIG. 3

HYDRAULICALLY DAMPED RAILWAY CAR BODY ROLL

This invention relates to a method and apparatus for controlling car body roll in high capacity railroad freight cars, and more particularly, to a method and apparatus for achieving effective body roll control when the car is loaded while providing for a soft ride for the body when the car is empty.

Railroad freight cars of the type designed to carry materials in bulk, as, for instance, hopper cars, gondola cars, tank cars, and the like, usually run under either full load or empty load conditions. In recent years, single purpose trains, commonly called unit trains, have been an outgrowth of this economic fact, the trains of this type carrying such materials as coal, potash and ore.

Over the years, the trend has been to increase the capacity of freight cars of this type so that at the present time 100 ton cars are common place. As such cars have gone up in capacity and carry larger loads, the center of gravity of the cars as loaded has moved upwardly, and, of course, the greater mass and higher center of gravity combine to accentuate the tendency of the car to rock or sway about its longitudinal axis as it moves along the track, when such factors as the truck and rail joint spacing, speed of movement, and basic spring rates of the truck spring groups are taken into consideration. This rocking or swaying motion is known generally in the field as car body roll, the end result of which can be a lifting of the car wheels off the track, and in many cases actual derailment.

This car body roll problem is a long standing problem in the railroad field and numerous ways have been devised for attempting to eliminate or at least control car body roll. Pure vertical movement of the bolster, as distinguished from the rocking or rolling motion that will be involved when body roll occurs, is commonly controlled by snubbing devices of various forms, one type of which is designed to take the place of one or more of the bolster spring group springs, another type of which involves friction shoes carried by the bolster that are spring biased against hardened friction surfaces applied to the side frame columns.

However, the control of harmonic rocking of high capacity freight cars at rocking speeds has come to be considered a separate problem for solution due to the facts of life in the railroad field that the rolling action involved occurs only under certain transit conditions, and that relatively large masses and thus forces have to be contended with while at the same time insuring a commercially acceptable ride for the car under transit speeds and conditions under which roll does not occur, as well as for empty load conditions. The nature of the problem is illustrated by the fact that experience has shown that any fully loaded car of 100 tons and up moving at speeds of 15–17 miles per hour that passes over three low rail joints in a row will develope a severe tendency to roll with significant likelihood of derailment. It is apparent under these conditions that body roll control is a mandatory requirement, but for speeds lower than 10 miles per hour and speeds above 20 miles per hour little or no roll control control is warranted and if then operative may adversely affect the ride characteristics of the car, especially under empty or no load conditions.

A principal object of this invention is to provide a roll control device for railroad freight cars that provides for full body roll protection when the car is loaded, and at the critical roll inducing speeds, but which also provides for the desired ride quanlity at lower and higher speeds of the car when loaded and the desired soft ride when the car is empty.

Another principal object of the invention is to provide a self contained hydro-pneumatic roll control device adapted for use in the conventional bolster spring group by using the device in place of one of the group conventional coil springs, which at the loaded car running height of the bolster, operates to effectively control body roll at the critical speeds, while providing for and accommodating a high quality ride at other speeds, and at the bolster empty car running height, operates to insure the soft ride needed for the car empty load running condition.

Still another principal object of the invention is to provide a spring group arrangement for supporting the truck bolster that includes a constant contact type roll control device of the hydro-pneumatic type that while being hermetically sealed, involves no sliding or dynamic seals, and accommodates without jamming some lateral motion of the basic moving parts of the device under lateral forces induced in the spring group due to relative movement of the bolster laterally of the side frame.

Still a further principal object of the invention is to provide a device and method of controlling car body roll utilizing two superposed bodies of trapped hydraulic liquid that are controlled to provide immediately effective firm resistance to roll tendencies while accommodating the bolster vertical movement that is needed for bolster movement between empty and loaded car conditions and high speed transit.

Yet other objects of the invention are to provide a hermetically sealed hydraulic roll control unit utilizing a pressurized gas charge to serve both as the unit return spring and as the biasing agency to maintain the unit in constant contact between its bolster and side frame seats, to provide a hydro-pneumatic roll control device that avoids the need for close manufacturing tolerances by utilizing the reduced tolerance requirements to provide for improved and unique operation, to provide a roll control device that not only is of few and simple parts, but also employs a single seal that has only low pressure exposures, and to provide a hydro-pneumatic roll control device that is economical of manufacture, that may be installed by merely replacing any one of the springs of the conventional truck spring group, and that is long lived and effective in operation.

In accordance with the invention, a hydro-pneumatic car body roll control unit is provided for inclusion in spring group arrangements to be employed for supporting the car truck bolster on its side frames; the particular bolster mounting arrangement employed may or may not provide for the dampening of pure vertical motion of the bolster, by employing one of the conventional commercially available ride stabilization arrangements.

The roll control device in accordance with the invention comprises three basic components, namely a lower base housing that seats on the side frame and defines an upstanding lower cylinder having an upstanding piston rod structure centered in same including a piston head at its upper end, a hollow ram that seats at its distal end against the bolster and is reciprocably mounted telescoping fashion in the lower, and thus outer, cylinder on the piston rod structure, and defines an upper, and thus inner cylinder, in which the piston head is received, and a tubular flexible seal received about the cylinders that is in hermetically sealed relation to the base housing and ram.

The seal has its upper end fixed to the ram distal or upper end, and has its other end inverted inside the seal and fixed to the base housing in addition to and in invaginating relation with the upper end of the base housing. The seal defines about the base housing and ram an annular chamber which serves the dual purpose of being a hydraulic liquid reservoir and providing the space for a pressurized gas pocket within the unit but externally of the unit cylinders for serving as the return spring of the device.

The base housing and ram cylinders, and the lower portion of the seal have a hydraulic liquid charge which the two cylinders subdivide into two vertically disposed bodies of trapped hydraulic liquid that are utilized to provide the roll control contemplated by the invention. The upper portion of the space enclosed by the seal is provided with a pressurized gas charge, using a suitable inert gas, such as nitrogen, to serve as the return spring of the device and other functions that will be elucidated.

The base housing and ram cooperating parts that have piston-cylinder device functions do not have the usual close fitting tolerance variations, but rather have a sufficiently loose fit to accommodate some hydraulic liquid seepage between the relatively movable piston-cylinder parts involved to accommodate vertical bolster movement due to static load changes.

The cylinder defined by the ram is provided with a passageway communicating between the upper end of the upper cylinder and the upper end of the gas pocket that is equipped with a relief valve for permitting controlled discharge of hydraulic liquid from the upper hydraulic liquid body into the reservoir when pressures within the upper hydraulic liquid body exceed a predetermined amount. The base housing piston head that operates within the upper cylinder is ported for large volume flow rate return stroke hydraulic liquid flow therethrough, and is equipped with check valving to block liquid flow therethrough on the device working stroke. The base housing piston rod structure in question is also provided with a liquid flow passage extending between its base, in communication with the lower cylinder, and the upper face of the piston rod structure piston head to accommodate limited hydraulic liquid flow between the two hydraulic bodies as part of the functioning of the device.

In addition, the internal side wall of the base housing cylinder, and the external side wall of the ram that is in reciprocable cooperation therewith, are formed to provide for fluid flow between the lower hydraulic liquid trapped body and the reservoir defined by the seal for accommodating fluid flow therebetween in the practice of the invention. The side wall of the ram is also ported for a shunt fluid flow from the reservoir to the space within the ram under the base housing piston head to enhance the return stroke of the roll control device.

The special roll control device forming the subject of this invention is incorporated in cars of the type indicated by using one of the devices in each of the truck spring groups, as by substituting the device for one of the springs of the spring group. Thus, one of the roll control devices of the invention is employed in each truck bolster spring group of the car.

With the car in question equipped as indicated, the roll control device of each spring group is operative to maintain constant contact between the bolster and side frame spring group seats involved. The roll control device also accommodates static load changes due to the provision of the indicated hydraulic liquid seepage or restricted flow that is permitted between the relative moving parts of the ram and base housing. The presence of the gas pocket effects the necessary bias on the device for return to riding position, or upward relative movement after downward deflection due to these normal vertical bolster motions that are largely if not entirely pure vertical in direction.

In the car loaded condition, when roll tendencies occur, the two trapped hydraulic liquid bodies of the individual control devices provide immediate resistance to downward bolster movement at the spring group of each such device involved. The upper hydraulic liquid trapped body acts essentially as a constant force deflection resistor, with hydraulic liquid discharge being made from the upper body into the reservoir when a predetermined pressure level in the upper body is exceeded. The lower trapped hydraulic liquid body acts as a velocity sensitive deflection resistor that provides supplemental resistance by the arrangement of the roll control device to provide for higher momentary pressures in the lower cylinder over the loads in the upper cylinder that are balanced by the restricted hydraulic liquid flow that comes from the lower cylinder to the upper cylinder to the base housing upstanding piston rod structure passage.

On the return stroke of the roll control device, the gas pocket has a two way biasing action on the components of the device; the ram is upwardly biased at its upper end by the action of the pressurized gas on same, and the hydraulic liquid within the reservoir is pressurized to flow into the lower cylinder through the indicated shunt porting and flow accommodating spacing and also subject the lower end of the ram, that is within the lower cylinder and engages the upper level of the lower trapped hydraulic liquid body, to an upwardly directed bias. This dual biasing action maintains the roll control device in its constant contact spring group seating position, and returns the parts of the device and its hydraulic liquid charge to normal riding position.

In the empty load condition the car bolsters will have risen under the static load changes involved to the bolster empty load height, which changes the relative positioning of the roll control device upper and lower cylinders so that the hydraulic liquid level in the reservoir drops below the top of the liquid flow providing spacing between the base housing cylinder defining wall and the ram external wall surfacing. Vertical movement of the bolster resulting as the empty car rides in transit effects a drawing of gas from the gas pocket into the base housing cylinder, from which gas also works into the cylinder defined by the ram, so that the roll control device is a spongy like soft riding action appropriate for empty car transit.

When the car is again loaded, the truck bolsters are returned to their loaded riding height due to the static load changes involved, which returns the hydraulic liquid level of the roll control device reservoir above the upper end of the base housing and closes off access of the gas in the gas pocket to the base housing cylinder. Gas remaining in the base housing cylinder will now seep back into the reservoir through the spacing between the base housing cylinder wall, and the normal vertical movements of the bolster in transit will purge the upper hydraulic liquid body of gas which is returned to the compressed air pocket.

Other objects, uses, and advantages will be obvious or become apparent from a consideration of the following detailed description and the application drawings in which like reference numerals indicate like parts throughout the several views.

In the drawings:

FIG. 1 is a diagrammatic end view of a high capacity railroad freight car showing the car body and major components of the truck in largely block diagram form, and illustrating the basic structural environment with which the invention is concerned;

FIG. 2 is an end view of a spring group arranged in accordance with this invention interposed between one end of the ride stabilized bolster and truck side frame of a standard make, with the bolster shown in its empty load height, and the bolster spring at the outer center position omitted to better show the roll control device of this invention;

FIG. 3 is a diagrammatic plan view of the spring group showing in FIG. 2, illustrating the positioning arrangement of the elements making up this particular spring group;

Figure 5:
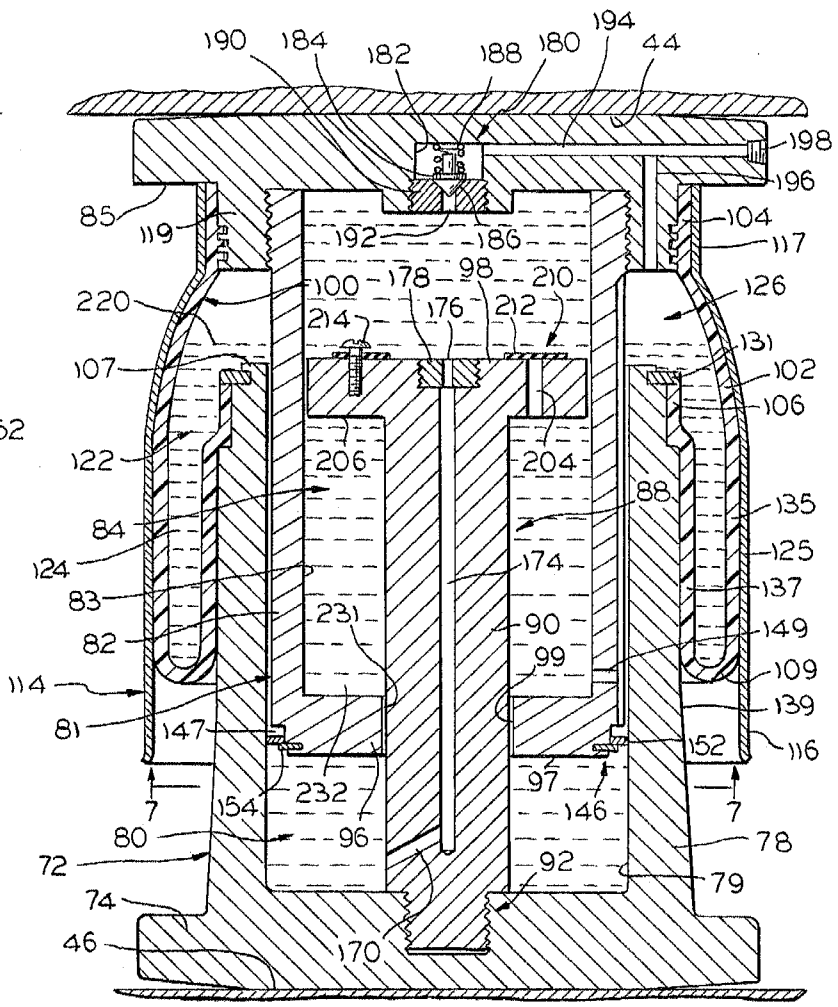
FIG. 5 is a view similar to that of FIG. 4, but showing the roll control device in its loaded car riding relation.

However, it is to be distinctly understood that the specific drawing illustrations provided are supplied primarily to comply with the requirements of the Patent Laws, and that the invention is susceptible of variations and changes that will be obvious to those skilled in the art, and which are intended to be covered by the appended claims.

GENERAL DESCRIPTION

Reference numeral 10 of FIG. 1 generally indicates a railroad car equipped in accordance with this invention. Car 10 includes the usual body 42, including underframe 14 applied in the usual manner adjacent each end thereof to bolster 16 of the individual car trucks 18 (only one car truck is shown in the end view forming FIG. 1), which bolster 16 at its ends 18 and 20 rests on spring groups 22 and 24 that are in turn supported by the truck side frames 26 and 28 which are journalled in the usual manner on truck axles 30 riding on wheels 32 which engage the usual track rails 34 of track 35.

The body 12 is illustrated largely in block diagram form and is intended to represent the various types of high capacity car bodies that are commonly employed today in 100 ton cars and the like, such as those referred to above.

The single truck 18 that is illustrated again is only diagrammatically shown, and is for the purpose of bringing out the principal structural environmental background application of the invention for illustrative purposes, it being understood that the truck 18 is intended to represent any commercially available railroad car ride stabilized truck equipped with a bolster 16 or its equivalent for supporting the car body 12, either at the center plate structure 36, or at the side bearings 38, or both.

As is well known in the art, the function of the spring groupings 22 and 24 is to resiliently support the car body 12. Heretofore it has been the practice to form the spring groups 22 and 24 by inserting a number of helical springs such as springs 40 and 42, or springs 40 alone, between the spring seats 44 and 46 defined by the bolster and side frames, respectively, with the number and sizes of springs employed depending on the load to be carried. In more recent years spring groupings of this type have been accompanied by snubber devices of various types to control the vertical movement of the bolster. Such snubber devices are generally known as ride stabilizing devices, a familiar form of which is embodied in the Barber S-2-C stabilized truck diagrammatically illustrated in FIG. 2 and indicated by reference numeral 47, which is of well known design and has a snubbed bolster 16. Bolster 16 is snubbed by snubbing devices involving friction shoes carried by bolster that are spring biased against hardened friction surfaces applied to the side frame columns, as is well known in the art.

In this connection, in practice the spring groups 22 and 24 are designed to support the bolster 16 and the load it carries at a predetermined elevation relative to the track rails 34, which may be spoken of in terms of positioning the spring seats 44 of the bolster a specified distance above the spring seats 46 of the side frames. Thus, the bolster 16 when car body 12 is riding empty will be riding at the empty load riding height or level 48 (see FIG. 1), while when the body 12 is loaded to rated capacity, the bolster 16 will be riding at a lower riding height or level 50 (it being assumed that for purposes of the disclosure the levels 48 and 50 are considered horizontally aligned with the bolster spring seats 44 under the load conditions indicated.

As indicated, the high capacity railroad cars that have come into wide use, have, by virtue of the higher center of gravity and heavier loads involved, made critical the problem of body roll insofar as high capacity equipment is concerned. Car body roll is caused by a number of factors, including location of center of gravity, weight being carried, truck and rail joint spacing, speed of movement, and basic spring rates of the resilient support for the car body. While the problem has been particularly acute in connection with 100 ton hopper cars when fully loaded, experience has shown that any fully loaded car of 100 ton capacity and up moving at speeds of 15–17 miles per hour that passes over three low rail joints in a row will likely develop a severe tendency to roll with significant likelihood of derailment.

In accordance with the present invention, the spring groups illustrated are provided with the hydropneumatic ride control device 62, the details of which are illustrated in FIGS. 4–9. For illustrative purposes, the ride control device 62 is diagrammatically illustrated in the diagrammatically illustrated spring groups 22 and 24 of FIG. 1, and in the more specific spring group showing of FIGS. 2 and 3, the spring group 64 is of the nine position type in which the center position is occupied by the roll control device 62, with the other spring positions being occupied by the respective springs 40 and 42. A feature of the invention is that the ride control device 62 is proportioned to be directly substituted for any of the springs 40 and 42 of the spring group 64, assuming the specific bolster and side frame arrangement of the truck involved permit this. For the specific commercially available truck illustrated in FIGS. 2 and 3, the location of the roll control device 62 is a practical and convenient location, and balances the spring group with no modification of the bolster or side frame being required. Where the truck involved has group spring retaining bosses, those at the selected location for the devices 62 should be removed prior to application of the devices 62. It is also to be understood that the devices 62 functionally could be located at any position in the group (assuming the specific bolster and side frames involved permit this, or can be modified to permit this).

Figure 4:
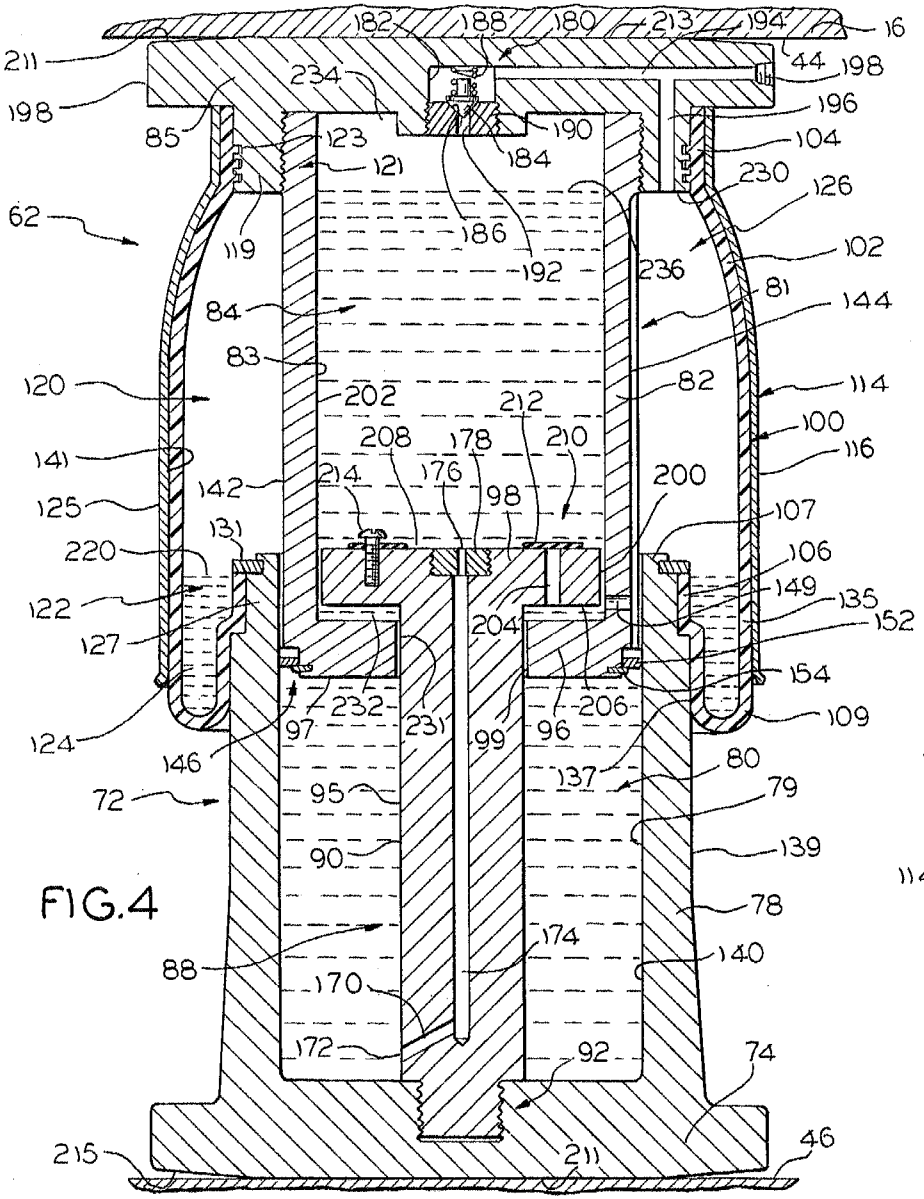
FIG. 4 is a vertical sectional view through the roll control device that is incorporated in the spring group shown in FIGS. 1–3, with the roll control device shown in its empty load riding relation.
Figure 6:
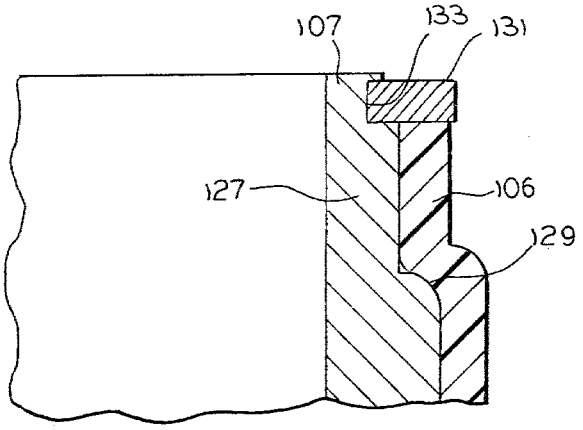
FIG. 6 is a fragmental sectional view of the upper edge of the roll control device base housing side wall better illustrating the manner of application of the device seal thereto.

Turning now more specifically to FIGS. 4 and 5, the roll control unit or device 62 generally comprises a base housing 72 having a flanged base 74 that is to rest on the truck side frame spring seat 46. Base housing 72 is formed to define the generally cylindrical upstanding side wall 78 defining a lower or outer cylinder 79 that forms hydraulic liquid receiving chamber 80. Reciprocably mounted in the cylinder 79 is the hollow ram 81 formed to define cylindrical side wall 82 defining an upper or inner cylinder 83 in turn defining hydraulic liquid receiving chamber 84. The ram side wall 82 has affixed to the upper end of same a flanged base plate or cap 85 which engages the spring seat 44 of bolster 16.

The base housing 72 has suitably mounted on its base 74 a fixed or stationary piston rod structure or assembly 88 comprising piston rod 90 that is fixed to the base 74 by suitable connection 92. The piston rod 90 extends through the piston rod opening 94 that is formed in the end wall 96 of the ram 81; the end wall 96 forms the head 97 of the ram 31 and the end wall opening 94 is defined by cylindrical surface 99.

In the form shown, the piston rod assembly 88 has integral with the piston rod 90 the piston rod head 98 that is reciprocably received in the upper cylinder 83.

Received in circumambient relation about the ram 81 and the upper end of the cylinder 72 is rolling seal 100 that is generally annular in configuration and that is formed from a fabric reinforced rubber or suitable polymeric material that is suitably resistant to the hydraulic liquid employed in the roll control device, as well as to weathering, corrosion, and the like. The seal defines a flexing annular side wall 102 that is generally tubular in nature, with one end 104 of the seal being suitably affixed to cap 85 and the other end 106 thereof inverted inside the seal wall 102 and fixed to the upper end 107 of the base housing side wall 78, and in invaginating relation with same, whereby the seal side wall 102 is shaped to define an annular depending open loop 109 extending below the inverted end 106 thereof as well as the upper end 107 of the base housing side wall 78.

Overlying the rolling seal 100 is a rigid protecting and movement guiding shield 114 that is in the form of a skirt 116 having a reduced neck portion 117 press fitted over the collar portion 119 of cap 85, with the end portion 104 of the seal 100 interposed therebetween whereby the end portion 104 of the seal is clamped in leak free relation with respect to the cap 85. The cap 85 in the form shown makes a suitable screw fitted connection to the ram side wall 82 as indicated at 121. For sealing purposes, the cap collar portion may be indented or recessed as at 123 whereby portions of the seal side wall 102 are indented into the recesses 123 by the compression application involved for further enhancing the seal that is made at the upper end 104 of the seal.

The shield 114 defines a depending cylindrical portion 125 that maintains the seal side wall 102 in its basic upright outline above the loop 109 that is illustrated in the drawings. In this connection, the end 106 of the seal is of reduced diameter and is force fitted over the upper end 107 of the base cylinder side wall 78, and specifically its side wall portion 127 that is of reduced external diameter and that merges into rounded shoulder 129 of the side wall 78 (see FIG. 6); the sealed end portion 106 is held compressed against the shoulder 129 by suitable lock ring 131 received in recess 133 formed at the top margin of side wall 78.

It is preferred that the proportioning of the internal diameter of the skirt cylindrical portion 125 relative to the housing 78 be such that the seal side wall 102 above the loop 109 define a cylindrical portion 135 that is in concentric relation to and parallels cylindrical portion 137 of the seal side wall that is below the shoulder 129 and above the loop 109, whereby the loop 109 is of 180 degree or reverse bend configuration form for roller like movement relative to the external surface 139 of the base housing side wall 78 and the internal guiding surface 141 of the shield 114 (that is defined by the shield cylindrical portion 125).

The seal 100 forms an annular chamber 120 about the base housing 72 and the ram 81, which in accordance with the invention, has the dual function of serving as a reservoir 122 for hydraulic liquid 124 with which the chamber 80 and 84 are charged, as well as a pressurized gas pocket 126 that is to serve as the return spring of the device 62.

It is an important feature of the invention that the fit of the ram 81 within the lower cylinder 79, and the fit of piston rod 90 within the ram end wall opening 94, as well as the fit of the piston head 98 within the upper cylinder 83, be free of close manufacturing tolerances while still having these cooperating components serve adequate liquid displacement functions in the general nature of a piston and cylinder device. This proportioning of the parts has several major objectives.

A basic feature of the device 62 is that a predetermined amount of fluid seepage is to be permitted between the side wall surfacings indicated for several purposes, as will be indicated hereinafter. In addition, it is desired that the ram 81 be reciprocably mounted with respect to the base housing 72 with a degree of lateral play that will allow for self alignment within the device 62 without the device 62 without risking jamming of parts.

In any event, for this reason, FIGS. 4 and 5 indicate a spacing between the side walls indicated which is deliberately oversized relative to the scale employed, to emphasize that this spacing of parts does exist to provide seepage ways for the fluid flow indicated. In practice, a clearance of about 0.002 inch is preferred.

Figure 7:
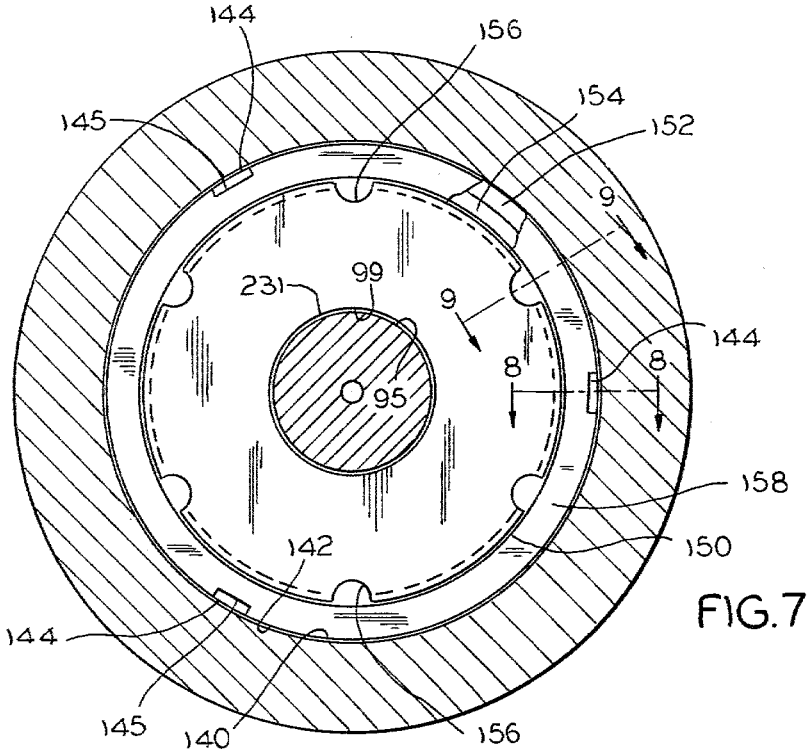
FIG. 7 is a horizontal sectional view through the roll control device, taken substantially along line 7—7 of FIG. 5, better illustrating some of the fluid flow channeling that is provided in accordance with the specific embodiment illustrated.

Another feature of the device 62 is that the inner side wall surfacing 140 of the lower cylinder 69 and the external side wall surfacing 142 of the ram side wall 82 are formed to define one or more fluid flow conduits or channels 144 extending longitudinally of the ram 81 for discharge into chamber 80, under the control of a check valve 146. In the form shown, the ram side wall 82 is shaped to define three grooves or slots 145, as indicated in FIG. 7, which extend from the upper end of the ram wall 82 to the level of the end wall 96, as indicated in FIGS. 4 and 5. The slots or grooves 145 form with the base cylinder side wall surfacing 140 the channels 144 that communicate with an annular pooling area 147 formed about end wall 96, as by recessing the lower corner of the ram 81 where indicated at 148 (see FIGS. 7–9) to define cylindrical wall 150 of reduced diameter on which is floatingly received the ring member 152 that is held in place by suitable lock ring 154. Lock ring 154 is suitably received in recess 155 formed in wall 150.

Figure 8:
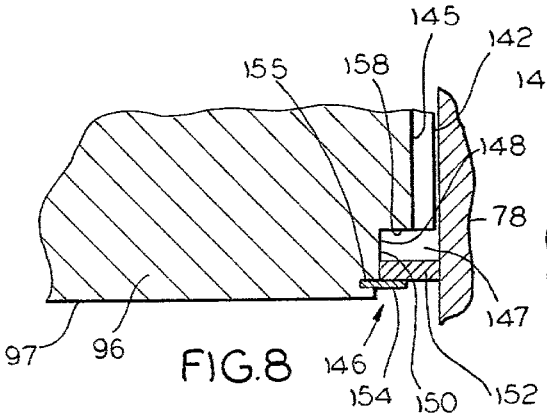
FIG. 8 is a fragmental cross-sectional view taken substantially along line 8—8 of FIG. 7.
Figure 9:
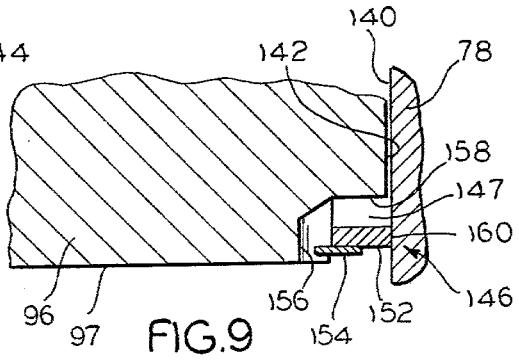
FIG. 9 is a fragmental cross-sectional view taken substantially along line 9—9 of FIG. 7.

The ring member 152 is essentially a "floating" ring as its position depends on the relative movement of ram 81. When ram 81 is static, ring member 152 will be disposed where it was left when ram 81 movement last ceased; when positioned as shown in FIGS. 8 and 9, or at a position short of external shoulder 158 (defined by ram end wall 99, see FIGS. 7–9), the pooling area 147 communicates through the respective spaced notches 156 formed about the ram end wall 96.

When downward movement of the ram 81 relative to cylinder 79 occurs, ring 152 is moved against the shoulder 158 to shut off communication between the grooves 144 and the notches 156 and thus the chamber 80. Thus, it is the flow of hydraulic liquid that effects the positioning of ring member 152 during operation of the device.

Ram side wall 82, adjacent end wall 96 but above check valve 146, is formed with a port 149 aligned with one of the slots or grooves 145 for enhancing the return stroke characteristics of the unit, as will be described. Port 149 may be sized to serve as a tuning expedient, and the side wall 82 may be formed to define similar ports 149 aligned with one or more of the other slots 145, as particular installation needs indicate.

Ports 149 provide a shortened return or shunt path for the hydraulic liquid from chamber 120 to chamber 84 on the return stroke of the unit, which is of benefit when the car body roll rate developed is higher than the unit is metered for. Ports 149 also insure that there will be a pressure differential on the two unit piston working surfaces involved.

The external contour of the outer margin 160 of ring 152 is made to substantially complement the internal contour of the chamber 79 as defined by interior side wall 140 for good liquid seal relation thereto (in the nature of a hydraulic cylinder piston ring) without, however, requiring tight fitting of parts for easy sliding movement of the ram 81 with respect to the cylinder 79.

The piston rod 90 is formed to define a lower diagonal passageway 170 leading from a port 172 at the base of the piston rod to passageway 174 extending along the axial center of the rod 90 for communication with an orifice 176 formed in orifice plate 178 that is suitably threadedably mounted in the piston head 98. The orifice 176 is of reduced cross-sectional area relative to the corresponding crosssectional area of the passages 170 and 174, in accordance with the invention as will be explained in connection with the description of operation of the device.

The cap or base plate 85 of the ram 81 is equipped with a check valve 180 operating in a valve chamber 182, which comprises a valve member 184 spring biased against valve seat 186 by compression spring 188. The valve seat 186 is suitably formed in valve seat member 190 and in the form shown in threadedly mounted in fluid tight sealing relationship with respect to the valve chamber 182. The member 190 is formed to define orifice opening 192 that is aligned in concentric relation with the valve seat 186. The valve chamber 182 communicates with the annular chamber 120 through connecting passages 194 and 196. Passage 194 extends to the rim 198 of the cap 85 to serve as the entry for the hydraulic liquid and pressure gas with which the unit 62 is charged. After charging, the external end of the passageway 194 is sealed closed by a suitable plug 198.

The piston head 98, as indicated, has its external side wall 200 proportioned for loose fitting relation with the internal side wall 202 of chamber 83. Head 98 is formed with a plurality of passages 204 communicating across the thickness dimension of same whereby hydraulic pressure liquid on the underside 206 of the piston head is passed through to the upwardly facing or head end side 208 of the piston head. While only one such passage 204 is shown in the drawings, the passages may be any suitable number (for instance three in the illustrated embodiment), but are preferably arranged in equally spaced relation about the center of the piston head for cooperation with ring type flap valve 210; valve 210 comprises ring member 212 that is applied over the passages 204 for limited movement toward and away from the piston head end side 208; the ring 212 in the form shown is held in mounted relation by a plurality of screws 214, for instance, three of such screws 214 located 120 degrees apart about the axis of the piston head 98 (suitably spaced, of course, from passages 204).

The function of the flap valve 210 is to close the passages 204 when ram 81 moves downwardly of the base housing 72, and to accommodate opening of the passages 204 when the ram 81 moves upwardly of the base housing 72, with the size of the individual passages 204 and the upward spacing of the ring 212 being proportioned for rapid hydraulic liquid flow through the piston head from the underside 206 to the head end side 208 of same on the return movement of the unit.

The base 74 of base housing 72 and the ram cap 85 are formed with the flat seating surfaces 211 and 213 that bear against the respective bolster and side frame seats 44 and 46; these surfaces are relieved or beveled thereabout as indicated at 215 and 217 respectively to accommodate movement of the bolster laterally of the side frame.

As already indicated, unit 62 is given a charge of hydraulic liquid and a pressure gas charge. This may be done through external end of the passage 194 utilizing a suitable valving arrangement, such as a Schrader type valve, that is removably mounted for this purpose. The oil is first entered into the unit in sufficient volume to fully charge the base housing chamber 80 and the ram chamber 84 with sufficient overage such that when the unit is in the loaded car position of FIG. 5, the level 220 of the oil will have the relative position indicated in FIG. 5 and thereby be above the upper end 107 of the base housing side wall 78. The hydraulic liquid employed should be an incompressible liquid such as a suitable grade of oil of the general type used for hydraulic jack or other similar purposes.

The gas pressure charge is applied to the unit 62 through the indicated Schrader valve and should be at a pressure of about four atmospheres in the free standing relation of the unit. The gas employed may be any inert gas such as nitrogen, though air may also be employed. The gas applied to the unit 62 forms the indicated gas pocket 126 about the upper end of the annular chamber 120 which acts to apply an upwardly directed bias to the ram 81 about the end cap 85 thereof, and specifically the downwardly facing rim surface 230 of its collar portion 119 in the illustrated embodiment.

The pressurized gas also applies a bias on the hydraulic liquid in the reservoir 124, which when the check valve 146 is open (the position of FIGS. 8 and 9) applies an upwardly directed bias to the ram head end 97.

In any event, the gas pocket 126 serves as the return spring of the unit 62, and will extend the unit 62 to its full free standing height that is defined by the engagement of the ram end wall 96 with the piston head 98.

As indicated, the units or devices 62 are to be proportioned to replace one of the springs 40 of the spring group 60. Thus, assuming that the railroad car 10 is equipped with the indicated Barber S-2-C stabilized trucks that have been previously referred to with regard to FIGS. 2 and 3, the two spring groups at either end of the bolster of such trucks may be equipped with a unit or device 62 in the manner indicated in FIGS. 2 and 3, with the devices 62 being handled in a manner similar to which springs 40 and 42 are conventionally handled for installation purposes.

When the car 10 is empty, its bolsters 16 ride at the empty load height indicated by level 48. Under this car riding condition, the roll control units 62 have the empty load riding relation illustrated in FIG. 4, under which conditions the level 220 of the hydraulic liquid 122 in the reservoir 124 is below the upper end of the base housing side wall 78, and the annular chamber 120 is shaped to have its maximum volume, with the gas pocket thus being under minimum pressure conditions, which will be somewhat above 4 atmospheres due to the concentration of the unit from its free standing height. The gas pocket 126 is thus open to direct access into chamber 80 through the ram side wall channels 144, the pooling area 147, and the notches 156. As the car 10 rides empty, the vertical movement of the bolster 16 that occurs reciprocates the ram 81 downwardly and upwardly of the base housing 72, drawing air into the chamber 80 through the indicated channels 144 and their connections to the chamber 80. The air becomes mixed in the hydraulic liquid of chamber 80.

The gas in the chamber 80 being lighter than the liquid in the chamber also rises into the ram chamber 84 through the fluid flow passages that are defined by the spacing 23; between the piston rod 90 and the ram end wall opening surface 99 through the space 232 beneath the piston head 98, within the chamber 84. The gas also passes through the fluid passageway defined by the marginal wall 200 of the piston head 98 and the internal surface 202 of the cylinder 83 to rise to the top of chamber 84, eventually forming a gas pocket 234 above the hydraulic liquid in chamber 84, which in the static condition after a period of car empty load travel will have a level approximately that indicated by reference numeral 236.

The presence of the gas in the chambers 80 and 84 causes the roll control device to reciprocate under vertical motion of the bolster with a soft spongy action that is consistent with and contributes to the soft ride provided the car by a spring group springs 40 and 42.

During empty load operation of the unit 62, the gas under pressure within the unit 62 maintains the ram cap 85 in full engagement with the bolster spring seat 44. In this connection, the device 62 is of the "constant contact" type, meaning that the upper end of the device as represented by the cap 85 is maintained in constant contact with the bolster seat 44 during all conditions of operation of the device as long as it remains part of the spring group 60.

When the car 10 is loaded to rated capacity, the car truck bolsters 16 move to the loaded car level 50. The static load changes involved apply a downward bias on the rams 81 of the devices 62 with which the car is equipped, through the car bolsters. It is a feature of this invention that the relatively loose fit between the ram side wall surface 142 and the base housing side wall surface 140, between the piston rod side surfacing 95 and the ram end wall opening surface 99, and between the piston head marginal surface 200 and the internal side wall surface 202 of chamber 84 permit a seepage type hydraulic liquid flow through the spacings involved that will accommodate a movement of the ram 81 downwardly of the base housing 72 at a rate up to about ½ inch per second, without bringing into play the roll resisting functioning of the unit 62 that would resist such downward movement. The channels 144 also accommodate this hydraulic liquid flow as valve 146 remains open during static load change conditions of the car.

As the downward movement of the ram 81 with respect to the base housing 72 continues under static load changes to move the bolster from its empty load level to its loaded level, the parts of the unit move to the relative positioning indicated in FIG. 5 in which the annular chamber 120 has decreased volume and the level of the hydraulic liquid in reservoir 124 has risen well above the upper end 107 of the base housing side wall 78. Gas remaining in the chamber 80 beneath the ram end wall 96, being lighter than the hydraulic liquid, returns to the chamber 120 through the valve 146 (which, as indicated, remains open during changes in static conditions of the car) and channels 144.

When the loaded car moves in transit, the normal vertical movement of the bolster and consequently the spring group will produce corresponding up and down movements of the ram 81 within the base housing 72 that are accommodated by the hydraulic liquid seepage between the ram 81 and the base housing side wall 78, the piston rod 90 and the ram head 96, and the piston head 98 and the upper cylinder side wall surface 202. This will result in the prompt elimination of the gas pocket 234 at the top of the ram 82, with the gas involved passing through valve 180, passages 194 and 196, and into annular chamber 120 to rejoin the other gas in the gas pocket 126.

During normal rail transit of the loaded car 10 at speeds below the critical 15–17 miles per hour, the car body is supported and the car bolsters insofar as their vertical movement is concerned are snubbed in a manner normal and conventional for cars equipped with snubbed bolster trucks. This vertical motion of the bolsters, which is normally largely if not entirely pure vertical in direction, is accommodated by the aforementioned hydraulic liquid flow that is permitted between the ram 81 and the base housing cylinder 79, as well as between the piston rod structure 90 and the ram 81 at the piston head 98 as well as at the end wall opening surface 94. Both valves 180 and 210 remain closed to hydraulic liquid flow for this type of bolster movement. When high speed transit occurs, the bolster will have a similar largely pure vertical movement of a shorter motion range which is accommodated by the movement of ram 81 relative to ring member 152 of check valve 146, as augmented by the built in hydraulic liquid seepage of devices 62.

When car body roll tendencies develop, however, the unit 62 immediately resists the downward movement tendencies of the bolsters that are involved. This resistance action for the individual roll control devices 62 is as follows:

As the bolster 16 moves downwardly toward the side frame spring seat 46, the ram 81 likewise moves downwardly of the base cylinder 72. When this movement rate exceeds the indicated one-half inch per second movement rate, check valve 146 closes with the ring 152 seating against the ram head surface 158. Flap valve 210 of course remains closed, with the result that the bodies of oil in the cylinders 80 and 84 are in effect trapped within the cylinders. These trapped oil bodies effectively resist downward movement of the bolster as soon as the aforementioned low speed rate movement of the ram 81 with respect to the base housing 72 is exceeded. The chamber 84 then acts as a constant pressure chamber with the relief valve 180 being arranged to open at a predetermined pressure level within the chamber 84 which in an operative embodiment of the invention is on the order of 1,200 psi, this effecting discharge of hydraulic liquid from the chamber 84 through the valve 180 in passages 194 and 196 into the annular chamber 120. Hydraulic liquid from chamber 80 passes between the piston rod 90 and the ram end wall opening surface 99 into the space 232 underneath the piston head 98, space 232 also receiving hydraulic liquid from chamber 120 through the slots or grooves 145 that have breathing ports 149. The hydraulic liquid leaving chamber 84 is equivalent to the volume of the space being occupied within chamber 84 by the additional entry of the piston rod 90 within the chamber 84, and similarly, as the ram moves downwardly of the chamber 80, hydraulic liquid is displaced from the chamber 80 through the piston rod passages 170 and 174 and the piston rod orifice 176 into chamber 84.

While the chamber 84 in resisting roll acts under essentially constant pressure conditions, the chamber 80 is velocity sensitive and thus will have pressures exceeding those in chamber 84 as critical load motion is opposed; this additional pressure is effected by the restricted nature of the orifice 176 through which hydraulic liquid flow emerges to ultimately balance the pressures in the two chambers.

As the unit 62 contracts in opposing roll, the rolling seal 100 rolls downwardly on the external wall surfacing 139 to the base housing side wall 78, lessening the volume of the chamber 120. This, in addition to the action of the hydraulic liquid being entered into the chamber 120 through the valve 180, increases the pressure of the gas in the chamber 120.

On release, the pressure of the gas on the chamber 120 urges the ram 81, about the cap 85, upwardly, to maintain the constant contact of the unit with the bolster seat 44. In addition, the pressure of the gas in the chamber 120 biases the hydraulic liquid to flow from the chamber 120 through the ram side wall channels 144, port or ports 149, and the now open check valve 146 into chamber 80. This also communicates chamber 120 with chamber 80 to apply an upwardly biasing action (induced by the gas pocket 126) on the ram end wall 96. Flap valve 210 shifts to the fully opened position under the pressure generated on the oil within the space 232 for large volume liquid flow of the hydraulic liquid through the piston head traversing passages 204 to the space within the chamber 84 above the piston head 98. As the ram 81 returns to its neutral or riding position, and thus partially leaves the chamber 80, hydraulic liquid also flows through orifice 176, and piston rod passages 174 and 170, into chamber 80 to complete the compensation for the space within the chamber 80 that has been evacuated by the upward movement of the ram 81. The port or ports 149 expedite the recovery stroke by shunting the hydraulic liquid flow through cylinder wall 82, as dictated by the needs of a particular installation.

When roll tendencies have been dissipated the unit 62 automatically returns to its slow rate oil seepage permitted vertical movement in accommodating normal vertical movement of the bolster.

It will thus be seen that a basic feature of the roll control unit 62 is that when roll tendencies are experienced, two bodies of trapped hydraulic liquid resist bolster downward movement under the roll tendencies; for lower velocities of such bolster movement the trapped oil bodies are essentially under equal constant pressure conditions, but for the more severe roll velocities, the lower trapped liquid body acts under velocity sensitive conditions and provides a supplemental resistance to the roll tendencies by virtue of the reduced hydraulic liquid flow rate through the orifice 176.

An important aspect of this development is that the resistance offered by the trapped oil bodies is immediate upon the indicated oil seepage contraction rate of the unit being exceeded. Prior art devices commonly require movement of the basic roll resisting components involved relative to each other, under the roll movement itself, before any substantial amount of resistance to roll is developed.

It will also be seen that as the unit 62 goes through its cycle in handling roll tendencies, the hydraulic liquid cycles through the unit; thus, hydraulic liquid is discharged from the chamber 84 into the chamber 120, while hydraulic liquid flows from the chamber 120 into chamber 80, and directly into chamber 84, with hydraulic liquid also moving from the chamber 80 into the chamber 84 through one or more of the passage defining connections between the unit chambers 80 and 84.

In a specific unit 62 that is preferred, the unit will have a free standing height of $10\frac{1}{2}$ inches. The empty load standing height is $9\frac{3}{4}$ inches and the loaded car operating height is $7\frac{3}{4}$ inches. The solid height of the unit is $6\frac{1}{2}$ inches, as compared to the usual 6-9/16th inch solid height for springs 40 and 42; thus, in practice the units 62 as installed will not go solid even though piston and cylinder structures are involved.

The general arrangement is such that while it is sized to replace one of the spring group springs 40, the general arrangement of the device provides a working area of some $12\frac{1}{2}$ square inches acting on the hydraulic liquid involved to resist roll.

In the static condition, the oil within the chambers 80 and 84 is under essentially no load conditions other than the biasing action induced by the gas pocket 126. The pressurized gas in the unit in the operation of the device has no appreciable shock absorbing effect, but rather serves to return the components of a level control unit to the riding position, and to provide for the soft car body ride at the empty load condition.

The biasing pressures provided by the spring pocket are increased as the unit contracts in resisting roll, due to both the reduction in the volume of the chamber 120 that is defined by the seal 100, and the entry into the reservoir 124 of hydraulic liquid from the chamber 84.

It is to be noted that the unit 62 involves no sliding or dynamic seals as such; in this connection, the ring 152 of check valve 146 is preferably in the nature of a split piston ring provided for the purpose of acting as a check valve rather than a fluid seal. The seal 100 is strictly a static seal with regard to the parts it is applied to and as the unit contracts and extends in service, the loop 109 moves upwardly and downwardly of the base housing side wall 78 with a smooth roller like action. The shield 114 maintains the configuration of the seal that is illustrated against the tendencies of the pressures acting within the chamber 120 to distend the seal laterally of the unit. This enables the operating space within the chamber 120 to be made variable based on the vertical movement of the ram 81 with respect to the cylinder, independent of any distending action on the seal laterally of the unit; in addition the seal 100 is also protected and kept free of contact with adjacent spring group springs, such as springs 40 and 42.

The surface 139 of the base housing side wall 78, and specifically the portion of same to be engaged by seal 100, may be shaped to adjust for or provide the ride characteristics discussed for a particular installation, as for instance to modify the soft ride point of the devices 62 with which a particular car is to be equipped, from that provided by the shaping indicated in the drawings.

The relatively loose fit between the basic components of the unit insure forced lubrication of all surfaces. The functioning of the ring 152 as a check valve makes it desirable for this ring to be of the expanding type for wear take up purposes and thus the ring 152 is not intended to be a fluid seal.

It will be observed that the parts of the unit 62 serving the purpose of pistons or rams are entirely enclosed within the unit, as are the spaces within the unit that are subjected to high pressures. The discharge of the hydraulic liquid from the passage 196 is parallel to the axis of the unit and thereby avoids impingement against the seal 114. The connections of the seal 100 to the base housing and ram cap are areas of relatively low pressure.

The forced lubrication that is involved in the operation of the unit, due to the loose fits provided for, minimizes wear of the critical surfaces involved. Furthermore, the loose fit of the components referred to accommodates relative lateral movement of the ram end base housing under lateral forces induced by the movement of the car parts they effect.

The general arrangement of the unit provides a piston working area on the hydraulic liquid involved that is essentially twice that of the usual piston acting in a cylinder. In the device of this invention in effect two piston and cylinder devices are provided that work in parallel, thus significantly increasing the working area of the piston and cylinder devices involved on the hydraulic liquid; this is a big factor in minimizing the heat generated by the operation of the device. Furthermore, this result is effected within the confines of the limited space to be occupied by one of the springs of a spring group 22 or 24.

The unit as illustrated operates at a ratio of about 12 to 1 in terms of resistance pressure versus internal pressure of the hydraulic liquid within the device. The four atmosphere gas pocket charge will give the unit 62 a dynamic load carrying capacity of 1,000 to 1,500 pounds for the empty load position, which increases to about 2,000 pounds at the loaded car position, and up to about 3,500 pounds when the springs of the respective spring groups have gone solid. Under such circumstances, the pressure in the gas pocket will go up to about 8 atmospheres at the fully retracted position.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A railroad truck roll control device for controlling railroad car body roll and adapted to be interposed in a spring group intermediate the truck bolster and a side frame of the truck, said device comprising:

a base housing defining an upstanding outer cylinder having an upstanding piston rod structure fixed with respect thereto that includes a piston head on its upper end, a hollow ram reciprocably mounted in said bolster cylinder on said piston rod structure for a full stroke of predetermined length and defining an inner cylinder in which said piston head is reciprocably mounted, a tubular seal concentric with said cylinders and having one end of same fixed to said ram adjacent the upper end of said ram, and the other end inverted inside said seal and fixed to said base housing adjacent to and in invaginating relation with the upper end of said base housing, thereby forming said seal to define an annular open loop extending below said inverted end thereof, said seal defining an annular chamber about said cylinders, a rigid shield encompassing said seal and fixedly carried by said ram, said shield having a guide portion that is concentric with said inner cylinder with said seal bearing on said shield guide portion, said ram being formed with conduit means for communicating fluid between said inner cylinder and annular chamber, and including normally closed relief valve means in said conduit means for releasing fluid under predetermined pressure in said inner cylinder to said annular chamber, said ram and said base housing defining passageway means between said annular chamber and said outer cylinder for fluid flow therebetween, check valve means positioned in said passageway means for restricting fluid flow through said passageway means when said ram moves downwardly relative to said base housing, with said piston rod structure, below said piston head, and said ram being formed to define therebetween a fluid flow way between said cylinders, and said piston head and said inner cylinder being proportioned for defining a fluid flow way therebetween between the upper and the lower sides of said piston head, said piston head being apertured for fluid flow therethrough between said sides of said piston head and including check valve means for precluding said fluid flow therethrough when said ram moves downwardly of said piston head, said piston rod structure being formed to define conduit means communicating between the lower end of said piston rod structure and the upper face of said piston head independently of said fluid flow ways for accommodating compensating fluid flow between said chambers in compensation for the volume space changes of said cylinders resulting from reciprocation of said ram relative to said base cylinder, said cylinders and the lower portion of said annular chamber being charged with hydraulic liquid, and the upper portion of said annular chamber being charged with gas under pressure for biasing said ram for movement upwardly of said base housing.

2. The roll control device set forth in claim 1 wherein:

the gas charge of said annular chamber is at a pressure of about four atmospheres.

3. The roll control device set forth in claim 1 wherein:

said piston rod structure conduit means includes flow restricting orifice means for making said outer cylinder velocity sensitive for supplementing resistance of said device to roll tendencies.

4. The roll control device set forth in claim 1 wherein:

the level of the hydraulic liquid charge of said device in said annular chamber in the emptyload relation thereof is below the upper end of said passageway means for entry of the gas charge into said cylinders.

5. The roll control device set forth in claim 1 wherein:

said shield is contoured to maintain said loop of said seal of reverse bend contour for the stroke length of said ram between load and empty load conditions.

6. The roll control device set forth in claim 1 wherein:

said inverted end of said seal is in tight fit relation with a reduced neck portion of said base housing, said base housing defining an external shoulder about the exterior of same adjacent to but below said seal inverted end portion, and means for compressing said seal inverted portion against said shoulder.

7. The roll control device set forth in claim 1 wherein:

said fluid flow ways and said conduit means are proportioned to accommodate a fluid flow rate therethrough such that said ram has a maximum movement rate downwardly of said base housing of up to about one-half inch per second free of compression stressing the portions of said hydraulic liquid charge in said cylinders.

8. The roll control device set forth in claim 1 wherein:

said ram conduit means leads from the upper end of said inner cylinder to the upper end of said annular chamber.

9. The roll control device set forth in claim 1 wherein:

said guide portion of said shield is cylindrical in configuration.

10. In a railroad car truck including a bolster supported from the truck side frames at either end of the bolster by a spring group interposed between the spring seats of the respective bolster ends and the side frames supporting same, whereby said bolster has empty and loaded car riding heights relative to the respective side frames, with said spring groups comprising a plurality of coil springs, the improvement wherein said groups each further comprise:

at least one roll control device, said device comprising:

a base housing defining an upstanding outer cylinder having an upstanding piston rod structure fixed with respect thereto that includes a piston head on its upper end, said base housing being seated on the side frame spring seat on the lower end of said base housing, a hollow ram reciprocably mounted in said outer cylinder on said piston rod structure for a full stroke of predetermined length and defining an inner cylinder in which said piston head is reciprocably mounted, said ram at its upper end being seated on the bolster seat, a tubular seal concentric with said cylinders and having one end of same fixed to said ram, adjacent the upper end of said ram, and the other end inverted inside said seal and fixed to said base housing adjacent to and in invaginating relation with the upper end of said base housing, thereby forming said seal to define an annular open loop extending below said inverted end thereof, said seal defining an annular chamber about said cylinders, a rigid shield encompassing said seal and fixedly carried by said ram, said shield having a guide portion that is concentric with said inner cylinder with said seal bearing on said shield guide portion, said ram being formed with conduit means for communicating fluid between said inner cylinder and annular chamber, and including normally closed relief valve means in said conduit means for releasing fluid under predetermined pressure in said inner cylinder to said annular chamber, said ram and said base housing defining passageway means between said annular chamber and said outer cylinder for fluid flow therebetween, check valve means positioned in said passageway means for restricting fluid flow through said passageway means when said ram moves downwardly relative to said base housing, with said piston rod structure, below said piston head, and said ram being formed to define therebetween a fluid flow way between said cylinders, and said piston head and said inner cylinder being proportioned for defining a fluid flow way therebetween between the upper and the lower sides of said piston head, said piston head being apertured for fluid flow therethrough between said sides of said piston head and including check valve means for precluding said fluid flow therethrough when said ram moves downwardly of said piston head, said piston rod structure being formed to define conduit means communicating between the lower end of said piston rod structure and the upper face of said piston head independently of said fluid flow ways for accommodating compensating fluid flow between said chambers in compensation for the volume space changes of said cylinders resulting from reciprocation of said ram relative to said base cylinder, said cylinders and the lower portion of said annular chamber being charged with hydraulic liquid, and the upper portion of said annular chamber being charged with gas under pressure for biasing said ram for movement upwardly of said base housing and maintaining the ram upper end in constant contact with the bolster seat.

11. The improvement set forth in claim 10 wherein:

said predetermined pressure in said inner cylinder is on the order of twelve hundred psi, the gas charge of said annular chamber is at a pressure of about four atmospheres at the free standing height of said device, with the hydraulic liquid charge being such that at the riding height of the bolster, the level of the hydraulic liquid in said annular chamber is below the upper end of said passageway means for entry of the gas charge into said cylinders for providing a soft ride at the bolster empty riding height.

12. The improvement set forth in claim 11 wherein:

the hydraulic liquid charge is such that at the loaded riding height of the bolster, the level of the hydraulic liquid in said annular chamber maintains the upper end of said passageway means fully submerged in said hydraulic liquid.

13. The improvement set forth in claim 11 wherein:

said fluid flow ways and said conduit means are proportioned to accommodate a fluid flow rate therethrough such that a said ram has a maximum movement rate downwardly of said base housing of up to about one-half inch per second free of compression stressing of the postions of said hydraulic liquid charge in said cylinders, said piston rod structure conduit means includes flow restricting orifice means for making said outer cylinder velocity sensitive for providing supplementary resistance of said device to roll tendencies.

14. The improvement set forth in claim 13 wherein:

said ram conduit means leads from the upper end of said inner cylinder to the upper end of said annular chamber.

* * * * *